US005979182A

United States Patent [19]

Goto et al.

[11] Patent Number: 5,979,182

[45] Date of Patent: Nov. 9, 1999

[54] METHOD OF AND APPARATUS FOR AIR SEPARATION

[75] Inventors: Masahiro Goto; Shuhei Natani, both of Takasago; Masayuki Tanaka, Osaka, all of Japan

[73] Assignee: Kabushiki Kaisha Kobe Seiko Sho, Kobe, Japan

[21] Appl. No.: 08/962,274

[22] Filed: Oct. 31, 1997

[30] Foreign Application Priority Data

Mar. 13, 1997 [JP] Japan ..... 9-059642

[51] Int. Cl.[6] ..... F25J 3/04

[52] U.S. Cl. ..... 62/643; 62/903

[58] Field of Search ..... 62/640, 641, 643, 62/903, 654, 653; 165/166

[56] References Cited

U.S. PATENT DOCUMENTS

| | | | |
|---|---|---|---|
| 1,549,236 | 8/1925 | Van Nuys | 62/643 |
| 1,604,240 | 10/1926 | Schlitt et al. | 62/643 |
| 2,316,056 | 4/1943 | De Baufre | 62/643 |
| 2,505,774 | 5/1950 | Holm et al. | 62/640 |
| 3,282,334 | 11/1966 | Stahlheber | 62/903 X |
| 4,208,198 | 6/1980 | Small | 62/903 X |
| 4,496,382 | 1/1985 | Geist et al. | 62/903 X |
| 4,721,164 | 1/1988 | Woodward | 166/372 |
| 5,036,672 | 8/1991 | Rottmann | 62/654 |
| 5,251,449 | 10/1993 | Rottmann | 62/653 |
| 5,265,429 | 11/1993 | Dray | 62/654 |
| 5,582,032 | 12/1996 | Shelton et al. | 62/643 |
| 5,813,250 | 9/1998 | Ueno et al. | 62/612 |

FOREIGN PATENT DOCUMENTS

| | | | |
|---|---|---|---|
| 649171 | 8/1993 | Australia | 62/643 |

*Primary Examiner*—William Doerrler
*Attorney, Agent, or Firm*—Oblon, Spivak, McClelland, Maier & Neustadt, P.C.

[57] ABSTRACT

Disclosed is a technique which makes it possible to restrain as much as possible the pressure loss, in particular, the pressure of return gas, generated in the main heat exchanger actually used when performing air separation and to reduce the power of the material air compressor as much as possible. In an air separation method of the type in which compressed air cooled through a main heat exchanger is supplied to a lower column of a rectifying tower equipped with upper and lower columns and in which return gas from the upper column of the rectifying tower is passed through the main heat exchanger to utilize it to cool the compressed air, an open end passage is provided in the main heat exchanger, and wherein the return gas is entirely or partly caused to flow through the open end passage, whereby a reduction in the pressure loss of the return gas is achieved.

9 Claims, 11 Drawing Sheets

BACKGROUND ART

METHOD OF AND APPARATUS FOR AIR SEPARATION

BACKGROUND OF THE INVENTION

1. Field of the Invention

The present invention relates to a method of and an apparatus for air separation and, in particular, to a method of and an apparatus for air separation of the type in which the material air is cooled through heat exchange with return gases by a main heat exchanger arranged in the air separation apparatus, wherein the pressure loss of the return gas lines is reduced as much as possible, whereby the efficiency and stability of the air separating operation are improved and a reduction in running cost is achieved.

2. Description of the Related Art

The air separation method for separating air into nitrogen gas and oxygen gas is used in various fields, such as steelmaking, chemical and electronic industries. Regarding this air separation method, research is being pursued for the purpose of achieving an improvement in terms of separation efficiency, a reduction in running cost, an improvement in operation stability, etc.

Given these goals, FIG. 1 is a flow diagram illustrating an example of a molecular sieve type air separation method developed and an apparatus for executing the method. Material air is transferred by way of an air filter 1, a material air compressor 2, a cooler 3, etc. and turned into air at a desired pressure, temperature and humidity (hereinafter referred to as "the compressed air") before it is led to molecular sieve adsorbers 6. In the example shown, there are provided a pair of molecular sieve adsorbers 6, which are selectively used. In the adsorbers 6, any water, carbon dioxide, hydrocarbon, etc. are almost completely removed from the compressed air by the adsorbing action of zeolite or the like. The compressed air is then led out of the adsorber 6 and transferred through a duct 6*a* and led to a main heat exchanger 7, where it is cooled down to a temperature around the liquefaction point through heat exchange with return gases described below before it is led to the lower section of a lower column 8*a* of a rectifying tower 8.

The compressed air thus led to the lower column 8*a* undergoes rectifying separation as it ascends within the lower column 8*a*. As a result, a nitrogen-rich liquid (liquid nitrogen) 9 of low boiling point is extracted from the upper section of the lower column 8*a* while an oxygen-rich liquid 10 of high boiling point is stored in the lower section of the lower column 8*a* (This process will sometimes be referred to as the "rough rectification process"). Nitrogen-rich gas in the upper section of the lower column is led through a duct 13 to a main condenser 8*b*, where it is liquefied before it descends through a duct 14 to return to the upper section of the lower column 8*a*. The nitrogen-rich liquid in the upper section of the lower column 8*a* is transferred through a duct 15 and led to the top section of an upper column 8*c* by way of a super cooler 12.

The above-mentioned oxygen-rich liquid 10, on the other hand, is led to the middle section of the upper column 8*c* by way of a duct 25 and the super cooler 12. Further, from the middle section of the lower column 8*a*, the liquid nitrogen which is in the middle stage of the rough rectification process is led to the upper section of the upper column 8*c* by way of the duct 11 and the super cooler 12. In this way, the lower-temperature liquid nitrogen and the oxygen-rich liquid 10 are led from the middle, upper and top sections of the upper column 8*c* and descend within the upper column 8*c*. Mass transfer is effected between the gas ascending within the upper column 8*c* and the lower temperature liquid nitrogen and the oxygen-rich liquid 10, whereby rectification proceeds.

By repeating these processes, nitrogen gas is separated in the top section of the upper column 8*c*, while liquid oxygen is stored in the lower section of the upper column 8*c*, oxygen gas being extracted from a position somewhat higher than the surface of this liquid oxygen. These gases are led to the main heat exchanger 7 through ducts 16 and 17, and heat exchange is effected between the compressed air led out from the molecular sieve adsorber 6 and these gases, whereby these gases are obtained, by cooling, as the nitrogen product and the oxygen product.

Part of the compressed air led out from the molecular sieve adsorber 6 is branched off before being led to the main heat exchanger 7. It is pressurized by a pressurizer 5*a* on the input side of an expansion turbine 5 and then cooled on the high temperature side of the main heat exchanger 7; then, it is extracted halfway and returned to the expansion turbine 5, where it undergoes adiabatic expansion to be thereby further cooled before it is led to the middle section of the upper column 8*c*. Exhaust nitrogen gas in a roughly separated state is extracted from a position somewhat lower than the upper section of the upper column 8*c* by way of a duct 20, and transferred from the super cooler 12 as return gas by way of the main heat exchanger 7 for heat exchange utilizing coldness. After that, the exhaust nitrogen gas which has undergone heat exchange is supplied to the adsorber 6 by way of a regenerative heater 29 and utilized for molecular sieve regeneration in the adsorber 6. The surplus exhaust nitrogen gas is supplied through a duct 21 to an evaporation cooler 4 to be used to cool cooling water to be utilized for cooling of the cooler 3 before it is discharged. After the regeneration/heating of the molecular sieve adsorber 6, the above-mentioned exhaust nitrogen gas is supplied to the adsorber 6 after regeneration/heating by the switching between valves $V_1$ and $V_2$ to cool it to thereby complete the preparation for switching to the adsorption process. The exhaust nitrogen gas utilized for the regeneration of the molecular sieve adsorber 6 is sequentially discharged to the exterior of the system.

In the main heat exchanger arranged in such an air separating apparatus, a number of units using corrugate fins (plane-type fins, herringbone-type fins, perforate-type fins, louver-type fins, serrate-type fins, etc.) are superimposed one upon the other and mounted as the main heat exchange members for high heat exchange efficiency, and the fluids to be subjected to heat exchange are caused to flow through adjacent units in opposed flows, whereby heat exchange is effected.

As is known in the art, in such an air separating apparatus, the power of the air compressor indicates the power performance of the apparatus. The lower the pressure at the outlet of the air compressor, the lower the power of the air compressor, and the more enhanced the performance of the apparatus as a whole. In view of this, various examinations are being made for the purpose of lowering the pressure at the outlet of the air compressor to thereby enhance the performance of the apparatus.

In the main heat exchanger used when executing the conventional air separation method, heat exchange is effected between the return gases (which mainly consist of the oxygen gas product, the nitrogen gas product and the exhaust nitrogen gas) and the compressed air (the material air), and the coldness of the return gases are utilized to cool the compressed air, which means, in the main heat exchanger, four kinds of fluid flow through flow passages defined by heat exchange walls. Thus, in order that heat exchange may be efficiently effected between these four kinds of fluid, a structure as shown, for example, in FIG. 6 (a general perspective view), FIG. 7 (a partially cutaway perspective view with the head portion taken away), and FIG. 8 (a front view showing a heat exchange unit provided with distributors for separation between the fluids), is adopted as the main heat exchanger.

In this main heat exchanger, generally indicated by symbol A, a number of heat exchange units in which corrugate fins are superimposed one upon the other through partitions constituting heat conduction walls are stacked together. The flow paths for the fluids are separated by distributors provided on the input and output sides of the heat exchange section. That is, as shown in FIGS. 8(A) through 8(D), four types of heat exchange units $A_1$ through $A_4$ are used, in which the flow paths on the input and output sides are varied by means of the distributors in accordance with the four kinds of fluid between which heat exchange is effected, and these units are superimposed one upon the other so as to be adjacent to each other to thereby constitute the main heat exchanger A. In FIG. 8, symbol HE indicates the heat exchange section; and symbols Da, Db, Dc and Dd and numerals $D_1$, $D_2$, $D_3$ and $D_4$ indicate distributors. In these distributors, the outlet and inlet sections are varied. For example, the heat exchange units $A_1$, $A_2$, and $A_4$ are used as the passages for nitrogen gas, the oxygen gas and the exhaust nitrogen gas, and the heat exchange unit $A_3$ is used as the passage for the compressed air, the heat exchange units $A_1$, $A_2$, and $A_4$ being stacked together, with the heat exchange unit $A_3$, which constitutes the passage for the compressed air, being placed therebetween, whereby an assembly as shown in FIGS. 6 and 7 is obtained to form the main heat exchanger A, with headers H being mounted to the inlet and outlet for each fluid.

In this conventional main heat exchanger, however, the flow direction of the fluid is changed in the output side distributor portion of each heat exchange unit, and each fluid flows in a condition in which the passage is narrower in the distributor portion than in the heat exchange section HE, so that the generation of a great pressure loss is inevitable. When such a pressure loss is generated in the passages for the return gases, in particular, in the passage for the exhaust nitrogen gas or that for the nitrogen gas, which gas has a great flow rate, the operating pressure of the air separating apparatus as a whole is adversely affected to a marked degree for the reason stated below, and the power of the material air compressor must be enhanced to a considerable degree.

SUMMARY OF THE INVENTION

The present invention has been made in view of the above problem in the prior art. It is an object of the present invention to establish a technique which makes it possible to restrain, as much as possible, the pressure loss generated in the main heat exchanger used when executing air separation and, in particular, the pressure loss of the return gases, and to reduce the power of the material air compressor as much as possible.

To achieve the above object, there is provided, in accordance with the present invention, an air separation method of the type in which compressed air cooled through a main heat exchanger is supplied to a lower column of a rectifying tower equipped with upper and lower columns and in which return gas from the upper column of the rectifying tower is passed through the main heat exchanger to utilize it to cool the compressed air, wherein an open end passage is provided in the main heat exchanger, and wherein the return gas is entirely or partly caused to flow through the open end passage, whereby a reduction in the pressure loss of the return gas is achieved.

In the invention described above, it is desirable to select the gas extracted in a great amount from the top section of the upper column of the rectifying tower or from the vicinity thereof, that is, the exhaust nitrogen gas or the nitrogen gas, as the above-mentioned return gas which is caused to flow through the open end passage since that makes it possible to further enhance the pressure loss reducing effect of the present invention. Further, when, in the execution of the present invention, the liquid oxygen at the bottom of the upper column of the rectifying tower is extracted and led to the evaporator, and part of the material air supplied to the lower column of the rectifying tower is utilized as the heating source for the evaporator, the pressure of the compressed air led to the lower column of the rectifying tower is reduced, that is, a further reduction in the power of the material air compressor can be achieved, and, further, the pressure of the oxygen gas product can be advantageously increased.

Further, in accordance with the present invention, there is provided an apparatus suitable for executing the above method, the apparatus being of the type which includes a rectifying tower equipped with upper and lower columns and a main heat exchanger and in which compressed air is supplied to the lower column of the rectifying tower by way of the main heat exchanger, return gas from the upper column of the rectifying tower being utilized to cool the compressed air through the main heat exchanger, wherein the main heat exchanger is equipped with an open end passage through which the whole or part of the return gas flows.

In the main heat exchanger used in the present invention, heat exchange is effected between the material air (compressed air) of the input side line and the exhaust nitrogen gas, the nitrogen gas product and the oxygen gas product on the output side line, that is, between four fluids. For that purpose, it is necessary for the four fluids to flow separately through the main heat exchanger. When one passage is formed as an open end passage as described above, it may become impossible to secure all the passages with a single distributor to secure the remaining three passages. Thus, in this case, it is effective to provide two distributors on the input and output sides of the heat exchange fluids to thereby make it possible for the four fluids to flow separately.

In this heat separating apparatus also, it is possible to more effectively enhance the pressure loss reducing effect by using the gas extracted in a relatively large amount from the top section of the upper column of the rectifying tower or from the vicinity thereof, that is, the exhaust nitrogen gas or the nitrogen gas, as the above-mentioned return gas that is caused to flow through the open end passage. Further, in this air separating apparatus, there is provided an evaporator for receiving the liquid oxygen at the bottom of the upper column, and there is provided a branch line which branches off the compressed air supply line to the lower column of the rectifying tower and which supplies the compressed air as the heating source for the evaporator, whereby it is possible, as stated above, to reduce the pressure of the compressed air led to the lower column of the rectifying tower (that is, to further reduce the power of the material air compressor) and to increase the oxygen gas product. Further, by selecting a corrugate-fin type heat exchanger as the main heat exchanger arranged in the air separation equipment of the present invention, and adopting a structure for the distributors, arranged at the outlet or the inlet for the fluid in the main heat exchanger, in which a plurality of supports are mounted at appropriate intervals leaving the space for fluid passage between the plates, it is advantageously possible to further reduce the pressure loss in the main heat exchanger.

DETAILED DESCRIPTION OF THE PREFERRED EMBODIMENT

Figure 1:
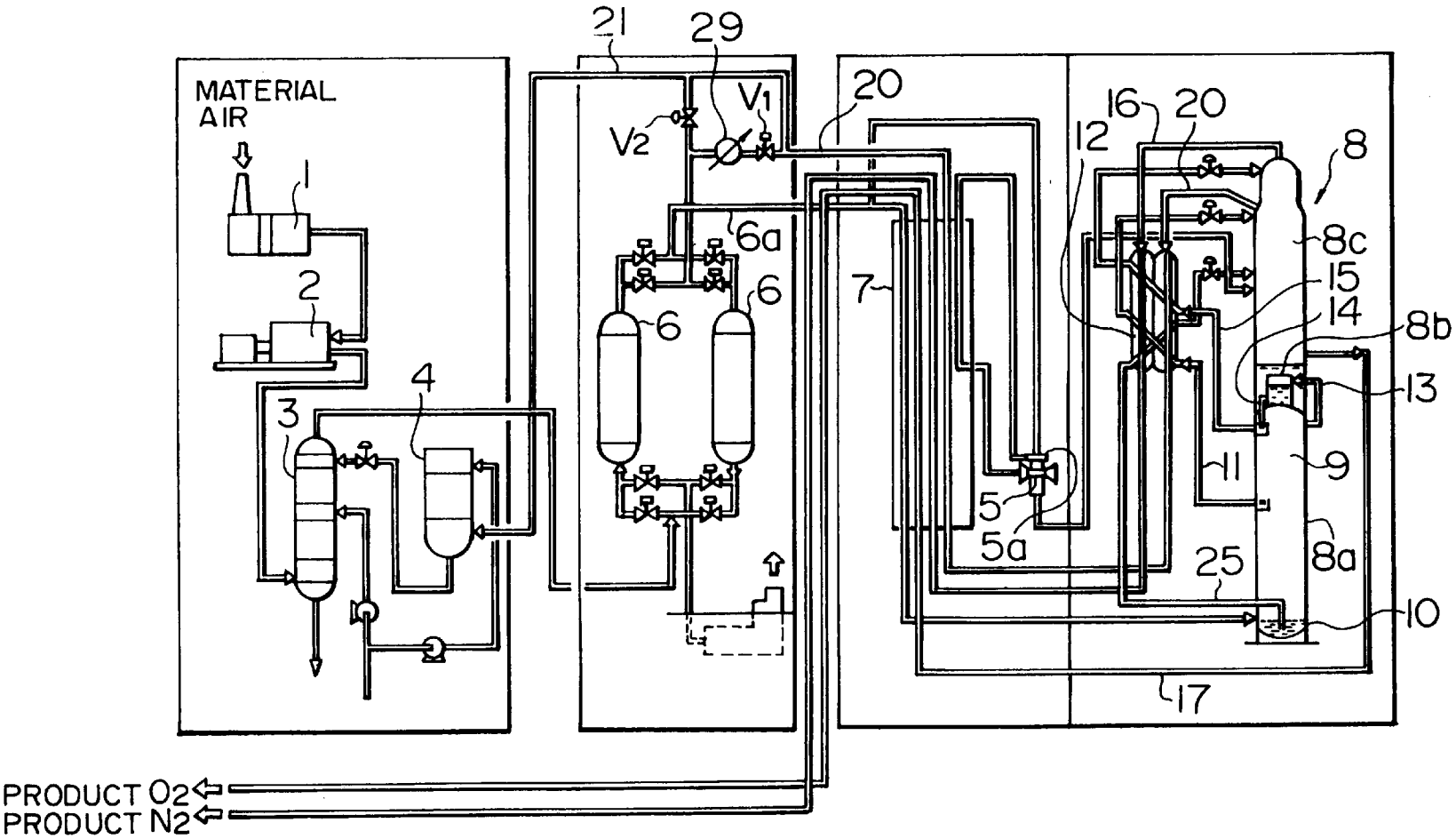
FIG. 1 is a schematic flow diagram showing an example of a method of and an apparatus for air separation to which the present invention is applicable.
Figure 2A:
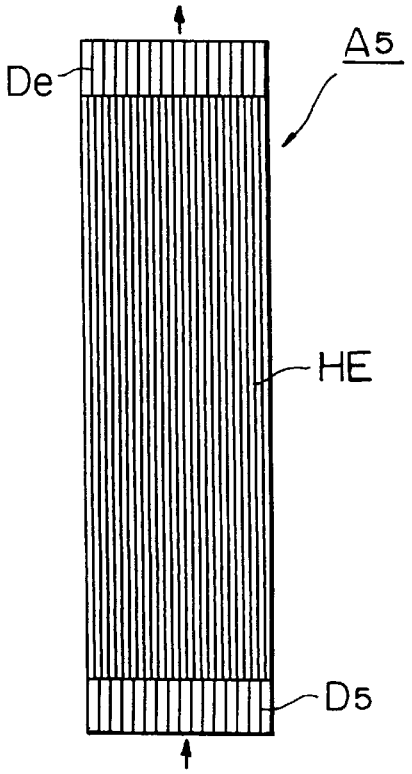
FIGS. 2(A) through 2(D) are schematic front views showing examples of heat exchange units constituting a main heat exchanger used in the present invention.
Figure 2B:
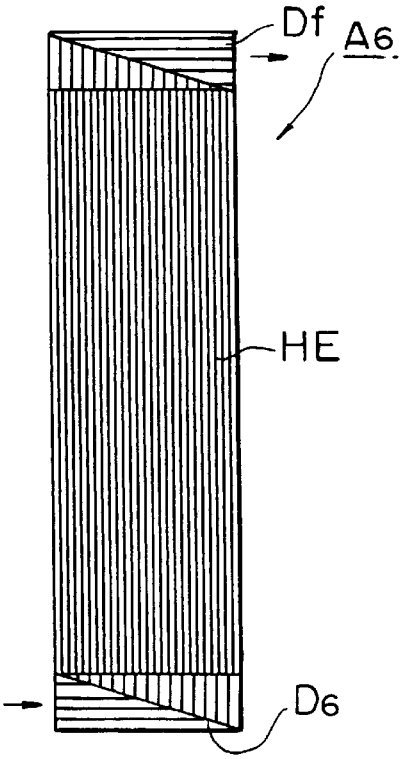
Figure 2C:
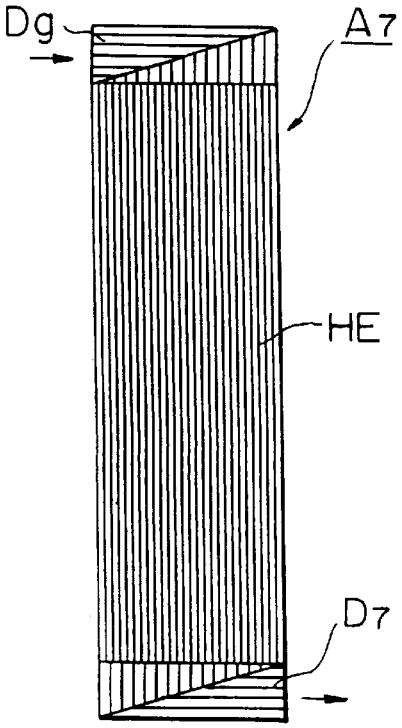
Figure 2D:
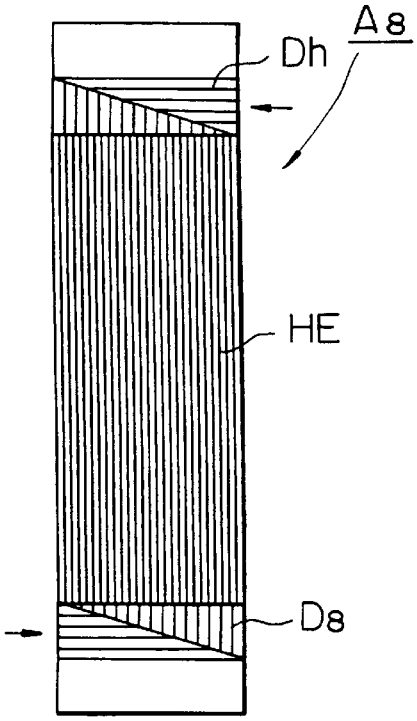

As described above, in accordance with the present invention, a method and an apparatus as shown in FIG. 1 are used, and, when cooling the compressed air with the main heat exchanger by utilizing the coldness of the return gas, the pressure loss of the return gas in the main heat exchanger, in particular, that of the exhaust nitrogen gas or the nitrogen gas extracted from the top section of the upper column or from the vicinity thereof, and, further, an increase in the power of the material air compressor is restrained, whereby the operational efficiency of the air separating apparatus as a whole can be enhanced.

Figure 3:
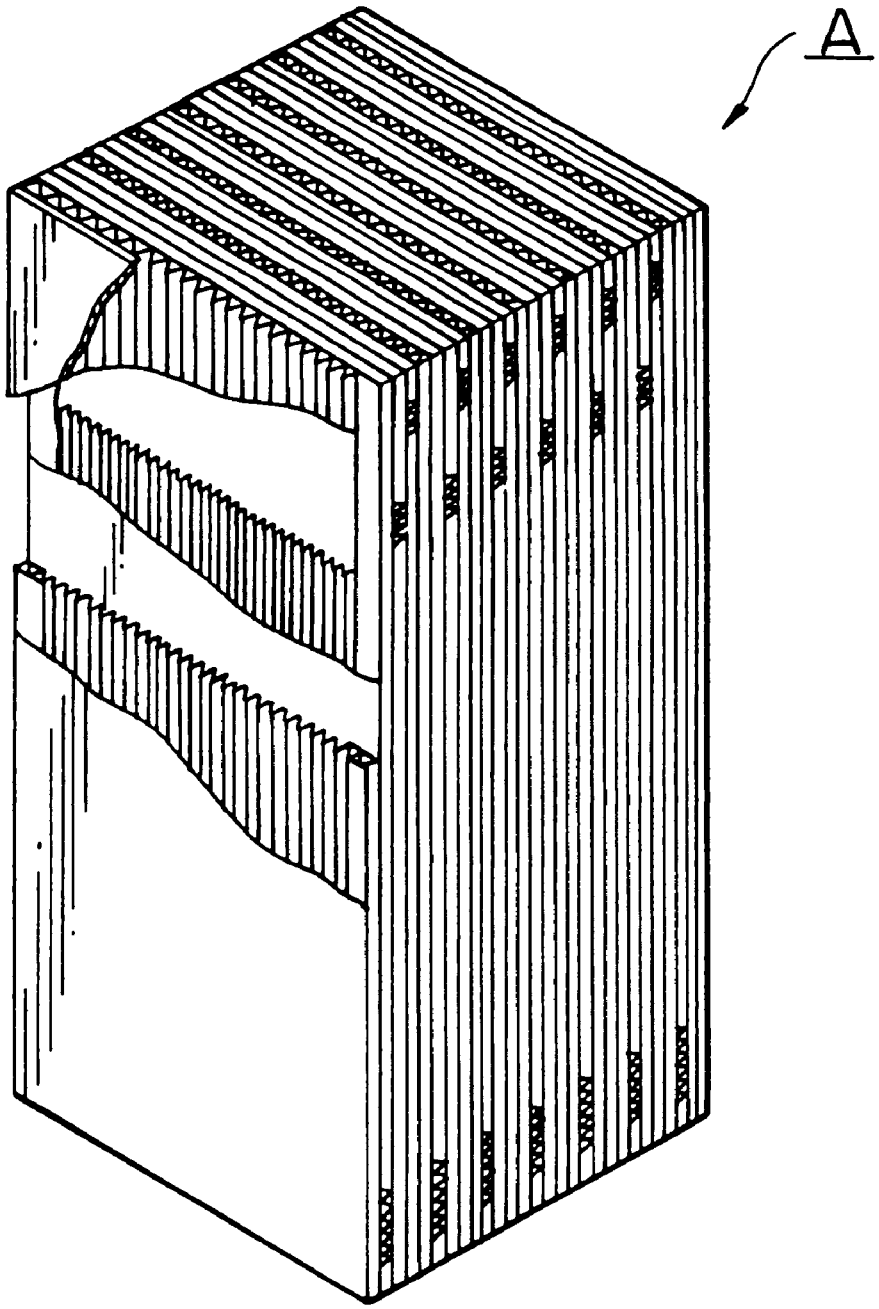
FIG. 3 is a partially cutaway perspective view showing the heat exchange unit of FIG. 2 in the assembled state.
Figure 4:
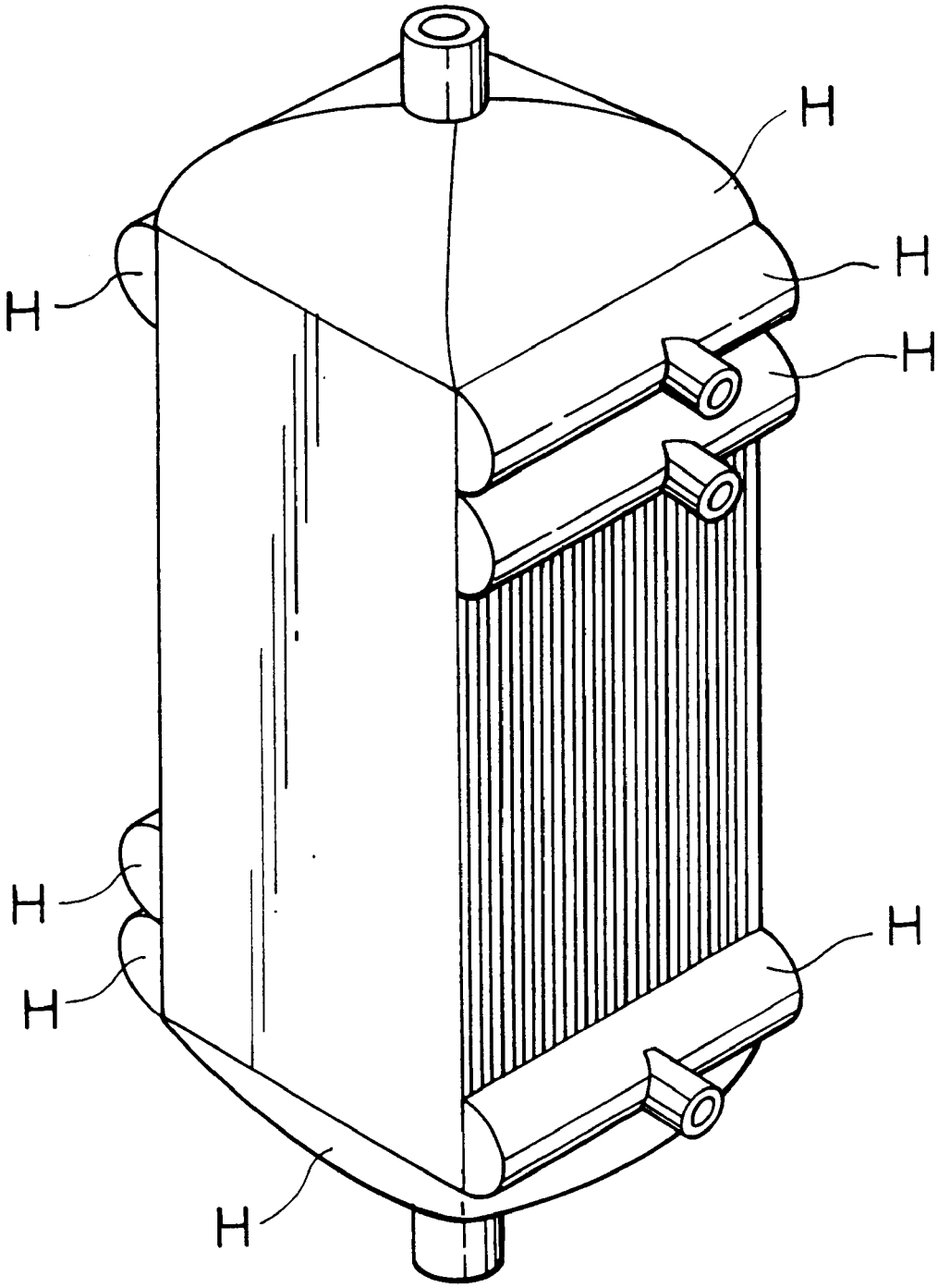
FIG. 4 is a perspective view showing a main heat exchanger in which headers are mounted to the inlet and outlet of each passage in the heat exchange unit assembly.

Specifically, when, for example, the air separation method as shown in FIG. 1 is executed, the main heat exchanger used is one constructed, for example, as shown in FIGS. 2 through 4. FIGS. 2(A) through 2(D) are schematic front views showing examples of a heat exchange unit constituting a main heat exchanger used in the present invention. As in the case of the example described with reference to FIG. 8, four types of heat exchange units are used in correspondence with the four fluids (the material compressed air and the return gases consisting of the nitrogen gas, the oxygen gas and the exhaust nitrogen gas) led to the main heat exchanger. In this embodiment, at least one type of heat exchange unit $A_5$ has an open end structure as shown in FIG. 2(A); two of the remaining types of heat exchange units $A_6$ and $A_7$ are constructed such that the fluid is led in from one side and discharged from the other side by means of distributors Df and Dg (This construction will be hereinafter referred to as the "side-in side-out type); and, in the remaining type of heat exchange unit $A_8$, a distributor Dh is provided at a position nearer to the heat exchange section HE than the mounting positions of the distributors of the heat exchange units $A_6$ and $A_7$ to form a side-in side-out structure. That is, when one of the four types of heat exchange units is formed in the open end structure, two of the remaining types of heat exchange units have to be formed in the side-in side-out structure for passage separation, and the remaining type of heat exchange unit must be in a side-in side-out structure in which the extracting position is shifted downwards.

These heat exchange units are stacked together and assembled as shown in FIGS. 3 and 4, and headers H are mounted on the input and output sides of the fluids to thereby form a main heat exchanger. In this embodiment, the exhaust nitrogen gas, which has the largest flow rate of the return gases, is caused to flow through the open end type heat exchange unit $A_5$ of the above four types of heat exchange units. As for the remaining types of heat exchange units, the nitrogen gas is caused to flow, for example, through the heat exchange unit $A_6$, the compressed air is caused to flow through the heat exchange unit $A_7$, and the oxygen gas, which has the least flow rate of the fluids, is caused to flow through the heat exchange unit $A_8$, whereby heat exchange is effected.

As is apparent from the example shown, in the above open end type heat exchange unit $A_5$, the flowing direction is not changed in the input/output side distributor portions; nor is the flow passage narrowed, so that substantially no pressure loss is generated in these portions. Thus, when the exhaust nitrogen gas, which has the largest flow rate of the return gases, is caused to flow through the open end type heat exchange unit $A_5$, it is possible to effectively restrain the pressure loss in the main heat exchanger portion of the return gas line and, further, it is possible to effectively reduce the power of the air compressor for the reason explained below.

That is, it has been ascertained that, in executing the air separation method shown in FIG. 1, the power of the air compressor is the power performance of the apparatus itself, and that the lower the pressure at the outlet of the air compressor, the lower the power of the air compressor to improve the performance of the air separating apparatus as a whole. The most effective measure to be taken to reduce the pressure at the outlet of the air compressor is to make as small as possible the pressure loss in the low pressure system in the air separating apparatus, in particular, the pressure loss in the discharge side gas line shown in FIG. 1, in which the gas is discharged to the atmosphere from the upper column 8*c* of the rectifying tower through the super cooler 12, the main heat exchanger 7 and the molecular sieve adsorber 6.

The present inventors have ascertained that reducing the pressure of the discharge side line by, for example, 0.1 kg/cm$^2$G results in the pressure at the outlet of the air compressor being reduced by approximately 0.35 kg/cm$^2$G. This is because the main condenser 8*b* is provided in the air separating apparatus, where heat exchange is effected between the oxygen at the bottom of the upper column of the rectifying tower and the nitrogen in the top section of the lower column, the differential pressure of the low pressure system being related to the differential pressure of the high pressure system depending on the boiling points under pressure of the oxygen and nitrogen.

Assuming, for example, that the boiling point of the oxygen at the bottom of the upper column of the rectifying tower is, for example, −180° C. at approximately 1.4 kg/cm$^2$A, this oxygen evaporates by the nitrogen in the top section of the lower column, which is at −178.2° C. and 5.4 kg/cm$^2$A (That is, the oxygen evaporates due to the nitrogen, and the nitrogen condenses). When the pressure of the oxygen at the bottom of the upper column of the rectifying tower is reduced by 0.1 kg/cm$^2$A to approximately 1.3 kg/cm$^2$A, the temperature becomes −180.7° C., and evaporation occurs due to the nitrogen in the top section of the lower column, which is at 5.05 kg/cm$^2$A and −179° C. That is, by reducing the pressure at the outlet from the low pressure system, i.e., the upper column, by 0.1 kg/cm$^2$A, the pressure at the inlet of the high pressure system, i.e., the lower column, is reduced by 0.35 kg/cm$^2$A (5.4–5.05 kg/cm$^2$A).

As is obvious from this, to reduce the pressure at the outlet of the air compressor when executing the air separation method, it is more effective to restrain the pressure of the low pressure system (that is, the extraction line from the upper column of the rectifying tower) than to restrain the pressure of the high pressure system (that is, the input side line leading to the rectifying tower). That is, making the pressure loss in the low pressure system as small as possible contributes greatly to the reduction in power when executing the air separation method. When the main heat exchanger arranged in the extraction line of the low pressure system has a construction as shown in FIG. 8, in which heat exchange units are combined with each other, an increase in pressure loss is inevitable due to the change in passage and the contraction of the passage generated in the distributor portion of each unit, as described above.

However, as described with reference to FIGS. 2 through 4, when the open end type heat exchange unit $A_5$ is used as one of the units constituting the main heat exchanger, and the exhaust nitrogen gas, which has the largest flow rate of the return gases, is caused to flow therethrough, it is possible to restrain as much as possible the pressure loss generated at the time of heat exchange of the exhaust nitrogen gas and, further, it is possible to effectively mitigate the pressure loss of the low pressure system. Further, this contributes to a reduction in the power of the air compressor.

Figure 5:
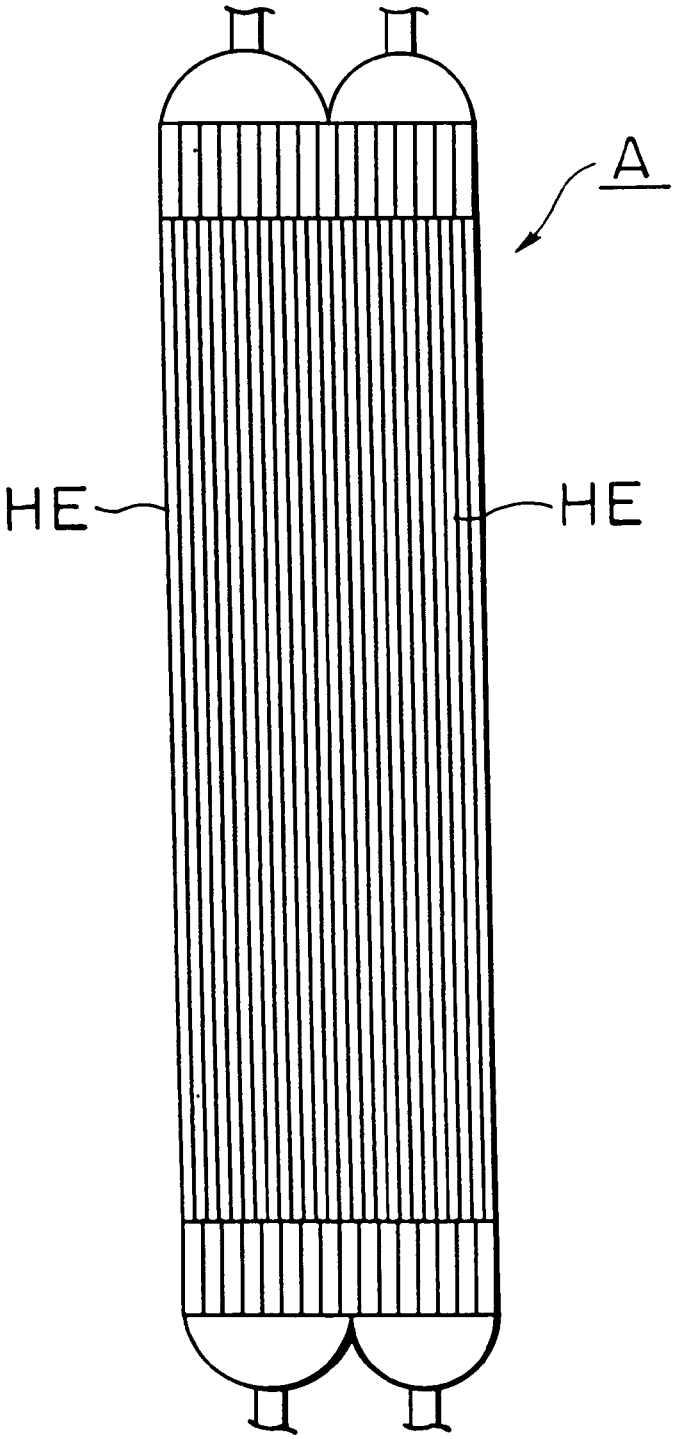
FIG. 5 is a schematic longitudinal sectional view showing another example of an open head type heat exchange unit used in the present invention.

In the above example, only the heat exchange unit through which the exhaust nitrogen gas flows is the open end type, and the other return gases are caused to flow through side-in side-out type heat exchange units. However, when the concentration of the nitrogen gas product may be relatively low, the flow rate of the nitrogen gas can be the largest of the return gases. In such a case, the nitrogen gas is passed through the open end type heat exchange unit. When there is not much difference between the flow rate of the exhaust nitrogen gas and that of the nitrogen gas, two sets of main heat exchangers of a combined structure as shown in FIGS. 2 through 4 are prepared; the exhaust nitrogen gas is caused to flow through the open end type heat exchange unit of one main heat exchanger, and the nitrogen gas is caused to flow through the open end type heat exchange unit of the other main heat exchanger, whereby the pressure loss in both fluids can be effectively reduced. Similarly, as shown, for example, in FIG. 5, an open end type heat exchange unit A may be longitudinally divided into two sections (preferably in a proportion corresponding to the flow rate proportion of the exhaust nitrogen gas and the nitrogen gas, and the passage is separated into two passages by two sets of headers H, the exhaust nitrogen gas and the nitrogen gas being respectively caused to flow through these passages, whereby it is possible to effectively achieve a reduction in the pressure loss of both fluids.

Thus, in accordance with the present invention, the main heat exchanger provided in the air separation apparatus has a construction as described above, whereby the pressure loss generated in the heat exchange section of the return gas line can be effectively restrained and the pressure loss of the low pressure line can be reduced.

Generally speaking, in a heat exchanger, a reduction in the flow velocity of a fluid results in a reduction in pressure loss. However, when the flow velocity is reduced, the heat transfer coefficient is also reduced, resulting in a deterioration in heat exchange performance. Further, to reduce the flow velocity, it is necessary to increase the cross-sectional area of the heat exchange section, resulting in the size of the heat exchanger becoming rather large. Thus, to keep a high level of heat transfer performance while achieving a reduction in pressure loss, it is desirable for the flow velocity, that is, the Reynolds number, to be not less than 600. Assuming, for example, that the Reynolds number of the exhaust nitrogen gas passage is 800, it is possible to achieve a heat transfer coefficient which is as high as 100 kcal/m$^2$h° C., thereby making it possible to secure a satisfactory heat transfer performance.

Another effective measure to be taken for the purpose of reducing the pressure loss of the main heat exchanger is to improve the construction of the distributor provided in the main heat exchanger. This will be described in detail below.

Figure 7:
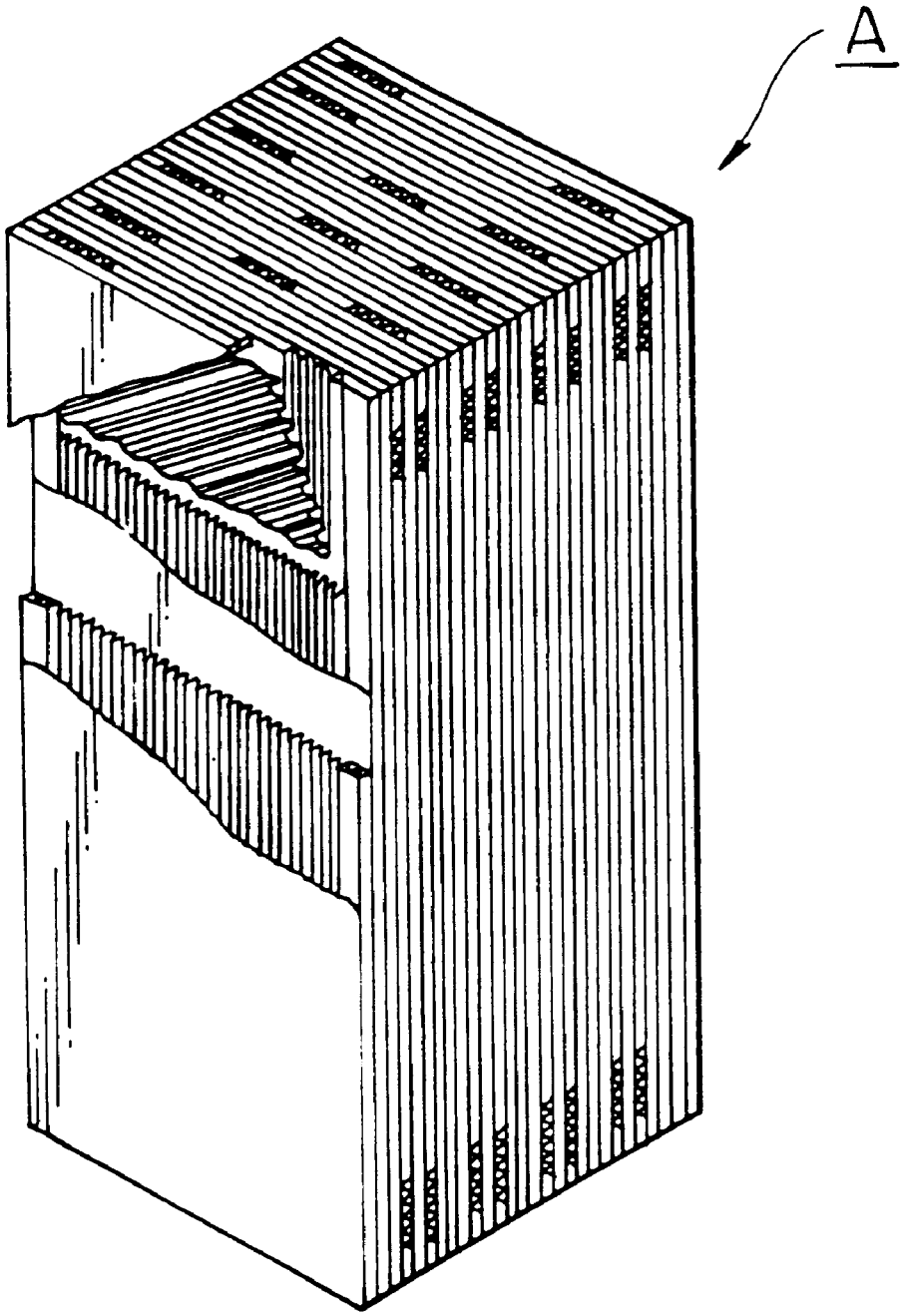
FIG. 7 BACKGROUND ART
FIG. 7 is a partially cutaway perspective view showing heat exchange units constituting the conventional heat exchanger in the assembled state.
Figure 8A:
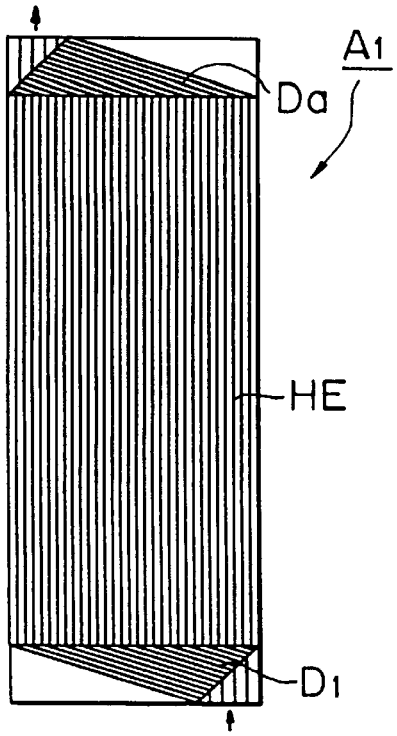
FIGS. 8(A) through 8(D) are schematic front views showing examples of the heat exchange units constituting the conventional main heat exchanger.
Figure 8B:
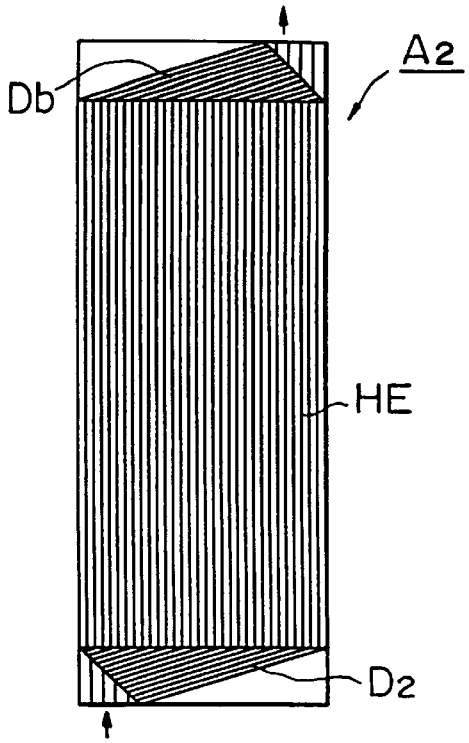
BACKGROUND ART FIG. 8B
Figure 8C:
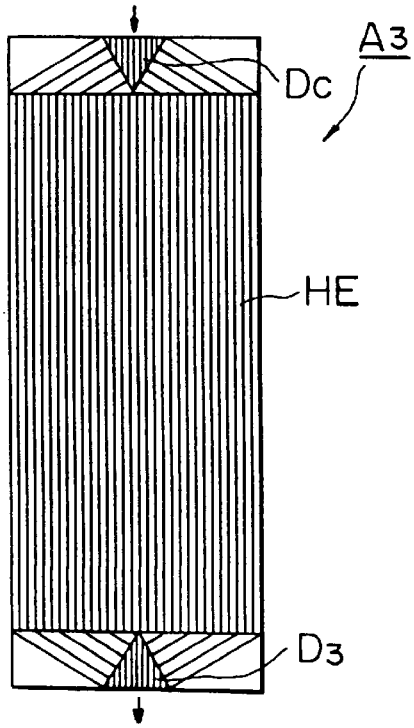
BACKGROUND ART FIG. 8C
Figure 8D:
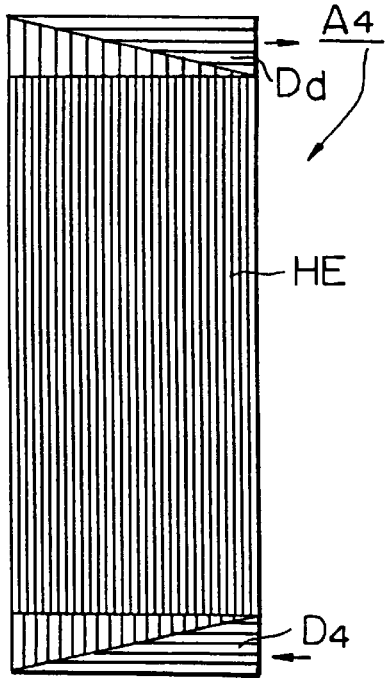
BACKGROUND ART FIG. 8D

A distributor is normally provided for the purpose of uniformly distributing a fluid introduced through the inlet in the heat exchange section HE in each unit consisting of large-width, minute-pitch corrugate fins. As shown, for example, in FIGS. 7 and 8, in an ordinary distributor, the fluid introduced is distributed in the width direction of the heat exchange section by rough-pitched corrugate plates, or the fluid is collected from the width direction of the heat exchange section before it is discharged.

However, in such a conventional heat exchanger, the flowing direction of the fluid is changed, in particular, in the outlet-side distributor portion of each heat exchange unit, and the fluid flows in a condition in which the passage is narrower than in the heat exchange section HE, so that the generation of a large pressure loss therebetween is inevitable. As stated above, this pressure loss can be restrained by adopting an open end type structure for the passage for the exhaust nitrogen gas, which flows in a high flow rate as stated above. However, the heat exchange units through which the remaining return gases (the nitrogen gas, the oxygen gas, etc.) are passed are of the side-in side-out structure, so that the flowing direction of the fluid is changed in the output side distributor portion of the heat exchange unit, and the fluids flow in a condition in which the passage is narrower than in the heat exchange section HE, with the result that a pressure loss is generated therebetween to a degree which is not negligible.

In view of this, further research was conducted with a view toward reducing as much as possible the pressure loss in the distributor portion of such a corrugate fin type heat distributor. As a result, it has been ascertained that it is possible to reduce the pressure loss in the distributor section more effectively by using a distributor structure in which a plurality of supports are mounted at appropriate intervals between plates leaving passage space for the fluids.

Figure 6:
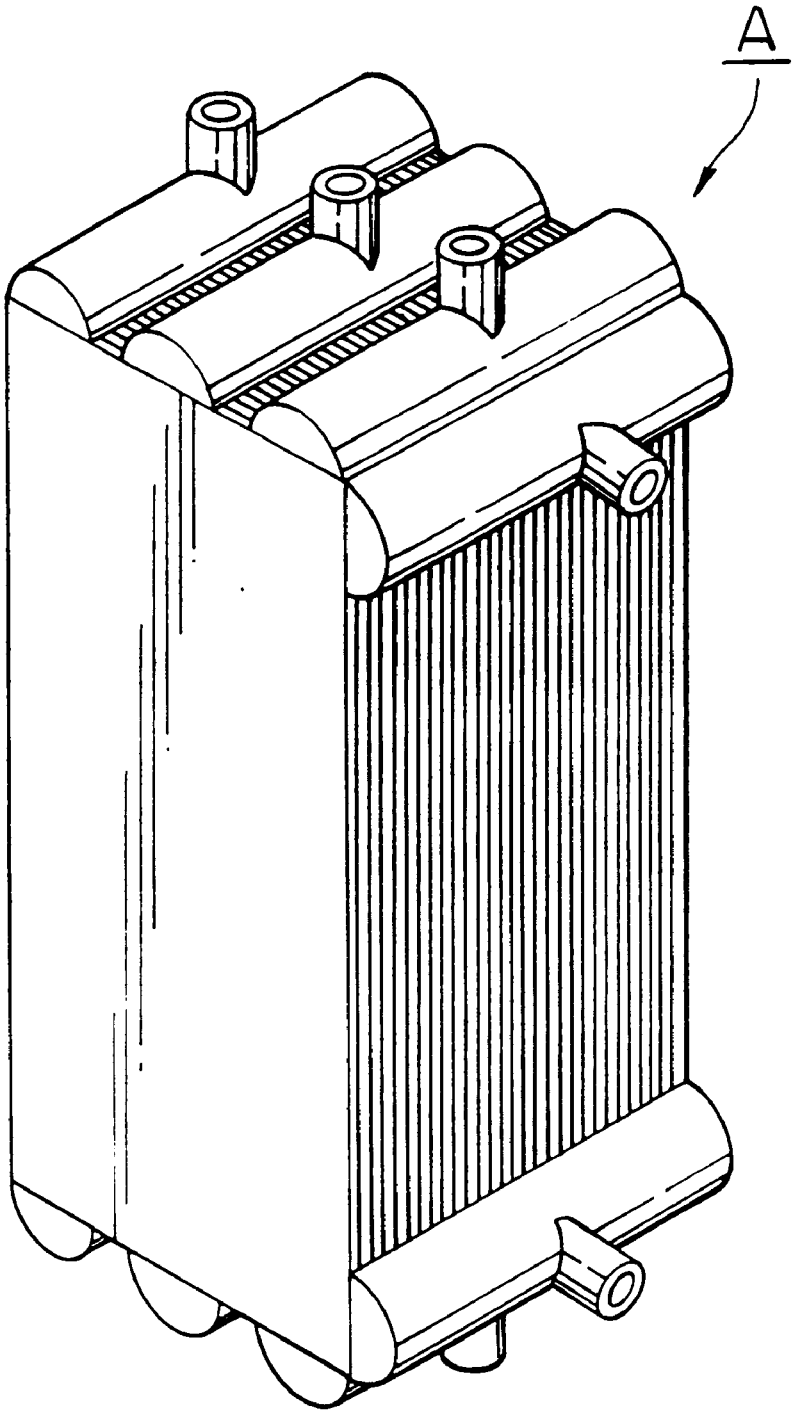
FIG. 6 BACKGROUND ART
FIG. 6 is a perspective view showing a conventional main heat exchanger provided in an air separating apparatus.

That is, as stated above, the ordinary distributor, provided in the corrugate fin type heat exchanger, is regarded as absolutely necessary in uniformly distributing the fluid introduced from the inlet of the heat exchanger in the heat exchange section HE in each unit consisting of large-width, minute-pitch corrugate fins. The construction adopted is one as is shown, for example, in FIGS. 6 and 7, in which rough-pitched corrugate plates are mounted between plates. As stated above, in this type of distributor, the generation of a large pressure loss in this portion is inevitable.

However, as a result of various researches conducted by the present inventors, it has been ascertained that, in the distributor, if a certain length is secured in the flowing direction of the fluid, the fluid is sufficiently distributed solely by keeping the inter-plate spaces hollow, without having to arrange corrugate plates within. However, when a number of heat exchange units with distributors mounted thereto are stacked together and mounted as the heat exchanger, a large clamping force acts between the plates constituting the distributors, so that it is necessary to secure a pressure tightness to withstand this clamping force.

That is, to secure a sufficient passage space for the fluid, it is regarded as effective to aim at a satisfactory pressure tightness rather than a satisfactory fluid distributing function when designing the distributor. However, in the conventional distributor of the type in which corrugate plates are placed between plates, the pressure tightness of the corrugate plates is insufficient, and there is a limitation to the reduction of passage resistance by enlarging their pitch, with the result that a considerable pressure loss is generated in the corrugate plate portion.

Figure 9:
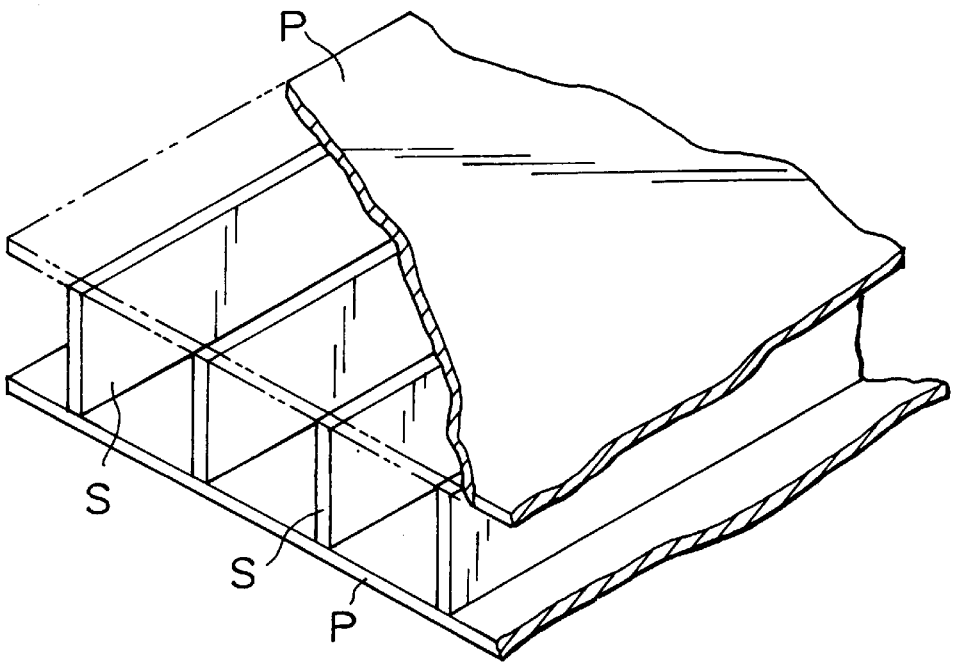
FIG. 9 is a partial perspective view showing an example of a main heat exchanger distributor preferably used in the present invention.

However, when the structure of the distributor is considered mainly aiming at an improvement in the inter-plate pressure tightness required particularly at the time of mounting, it is found that it suffices to mount as shown, for example, in FIG. 9, supports S at arbitrary intervals between the plates P to secure a pressure tightness high enough to withstand the clamping force at the time of mounting. That is, these supports S function as beams between the plates P, and can sufficiently withstand the clamping force applied from above and below in the drawing. As compared to the conventional corrugate plates, these supports provide an excellent pressure tightness, so that they make it possible to secure sufficiently large mounting intervals. That is, it is possible to secure a sufficiently large passage space for the fluid, so that it is possible to restrain the pressure loss in the distributor portion as much as possible.

There is no particular limitation regarding the configuration and structure of the supports, which are mounted at appropriate intervals between the plates P provide the requisite pressure tightness. To secure passage space for the fluid, it might be effective to adopt supports whose cross-sectional configuration is round, rectangular, etc. However, when such supports are adopted, the operation of brazing the ends of the supports to the plates P will be very complicated, resulting in a high production cost. Further, a mass production would be difficult. Thus, from the viewpoint of the production cost and productivity, plate-like supports S shown, for example, in FIG. 9 are advantageously adopted, which are mounted by a well-known means such as brazing.

Figure 10:
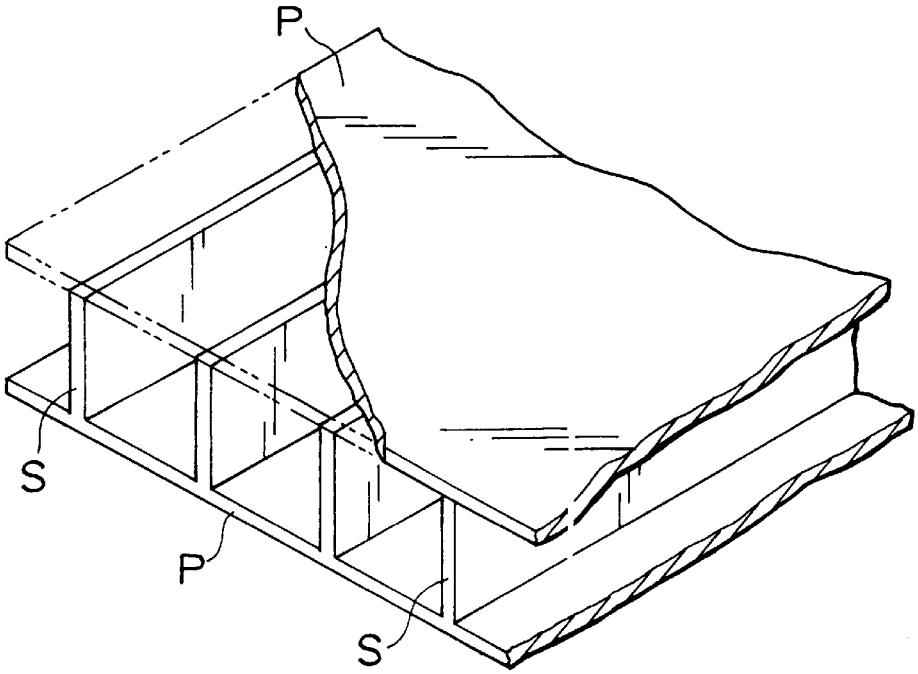
FIG. 10 is a partial perspective view showing another example of a main heat exchanger distributor preferably used in the present invention.

If, as shown in FIG. 10, the plate-like supports S and one of the plates P are integrally formed by drawing or the like, and the other plate P is joined to the other ends of the supports S, the positioning, the position securing, etc. at the time of mounting the supports S can be conducted very easily. Thus, this structure is most advantageous from the viewpoint of practicality since it can be produced with ease.

Figure 11:
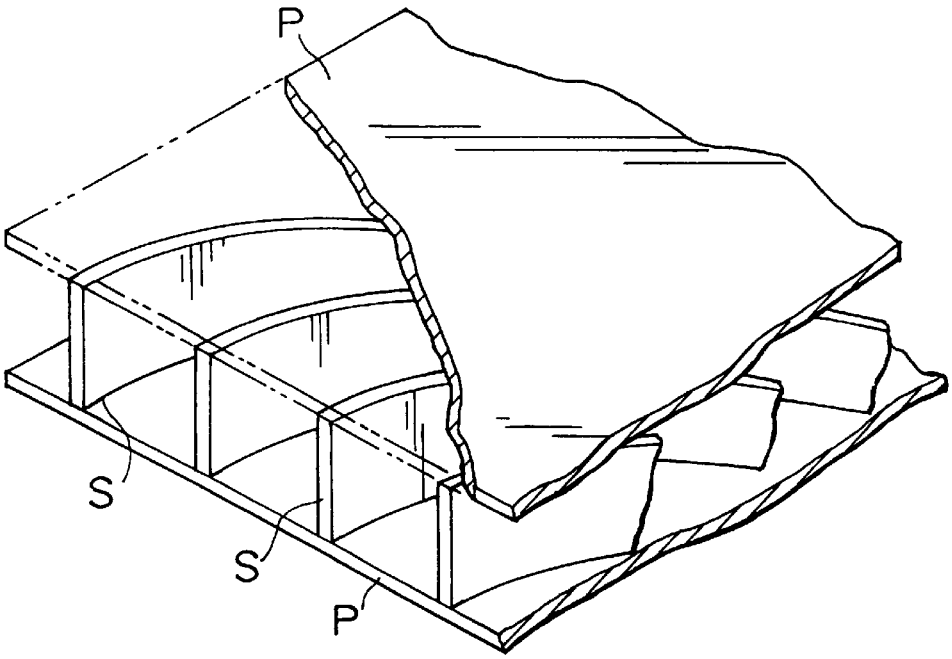
FIG. 11 is a partial perspective view showing a still another example of a main heat exchanger distributor preferably used in the present invention.
Figure 12:
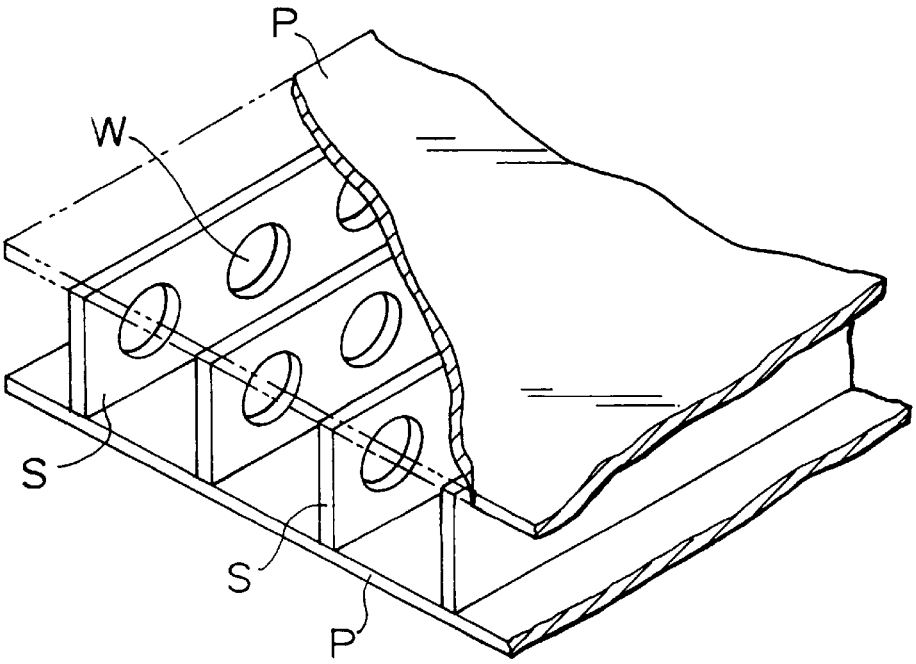
FIG. 12 is a partial perspective view showing a further example of a main heat exchanger distributor preferably used in the present invention.

However, as stated above, the present invention is characterized in that the pressure tightness between the plates is enhanced by the supports. Thus, there is no particular limitation to the configuration or structure of the supports, and it is naturally also possible to use supports of some other configuration and structure, for example, ones in the form of bars. Further, when using supports in the form of plates, they are not restricted to linear ones; they may, for example, be curved in the flowing direction of the fluid as shown in FIG. 11 to thereby reduce the flow resistance, or they may have an arbitrary number of holes W in an arbitrary configuration and size as shown in FIG. 12 to thereby enable the fluids to flow separately through these holes W.

Regarding the mounting intervals of these supports S, it is advantageous, from the viewpoint of reduction in pressure loss, to make the intervals as large as possible in so far as the requisite pressure tightness can be secured. The present inventors have ascertained that, to effectively obtain the pressure loss reduction effect, the pressure loss in the heat exchange unit can be sufficiently reduced by mounting the plate-like supports at intervals three to fifteen times as large as the fin pitch of the corrugate fins constituting the heat exchange section (for example, that indicated by symbol HE in FIG. 2) in the heat exchange unit used. When the mounting intervals are so large as to be beyond fifteen times the fin pitch, the pressure tightness tends to become insufficient or it is necessary to make the supports excessively fat. When, on the other hand, the support mounting intervals are less than three times the fin pitch, a satisfactory pressure loss reduction effect is hard to obtain while the pressure tightness is enhanced to a sufficient degree.

The relationship between the design pressure, pitch and plate thickness of a corrugate fin type heat exchanger can be expressed by the following formula:

$$t_p = P_t\sqrt{(P/200\sigma a)}$$

$t_p$: thickness of the separate sheet, $P_t$: pitch,

P: pressure, σa: allowable stress of the material (which is 2.3 in the case of an ordinary Al alloy)

Since the thickness of the sheet used in a heat exchanger corrugate fin is usually 1 mm, and σa is 2.3, the pitch $P_t$ when the design pressure is, for example, 1.0 kg/cm$^2$G can be obtained from the above formula as follows:

$$\begin{aligned} P_t &= t_p\sqrt{(P/200\sigma a)} \\ &= 1.0/\sqrt{(1.0/200\cdot 2.3)} \\ &= 21.4 \text{ mm} \end{aligned}$$

To secure the requisite strength to withstand the load when mounting the heat exchange unit by brazing, the buckling strength ($P_{cr}$) obtained by the following calculation must be satisfied:

Buckling strength ($P_{cr}$)=$4\pi^2 EI/l2$, $I=tl^3/12$ (where E: elastic modulus, I: geometrical moment of inertia, l: fin height, t: fin plate thickness)

The buckling strength $P_{cr1}$, $P_{cr2}$ of two types of corrugate fins made of the same material and having the same fin height and different plate thicknesses (which means E and l are the same) can be calculated as follows:

When the fin plate thickness is $t_1$:

$$P_{cr1}=[4\pi^2\cdot E\cdot(t_1\cdot l^3/12)/l^3)]$$

When the fin plate thickness is $t_2$:

$$P_{cr2}=[4\pi^2\cdot E\cdot(t^2\cdot l^3/12)/l^3)]$$

From the above equations, $$P_{cr1}/P_{cr2}=t_1/t_2$$

Further, under the condition that the same buckling strength is to be secured, the fin pitch (P) and the fin plate thickness (t) are in a substantially proportional relationship, so that the following equation holds true:

$$t_1/t_2=P_{t1}/P_{t2}$$

The plate thickness of the 4.2 mm pitch fin generally used as the corrugate fin of a main heat exchanger for an air separating apparatus, for example, is 0.4 mm. As stated above, the design fin pitch when the plate thickness is 1 mm is 21.4 mm. By substituting these values into the above formula to obtain a fin plate thickness to provide a buckling strength to withstand the load at the time of mounting, the following result is obtained:

4.2/0.4=21.4/t, that is, t is approximately 2 mm. Thus, the fin thickness is 2 mm at a pitch of 21.4. As compared with a structure in which the fin thickness is 0.4 mm at a pitch of 4.2, this makes it possible to secure a larger passage area.

The fin pitch of ordinary corrugate fins used in a heat exchanger is 4.2 mm at the maximum and 1.4 mm at the minimum. Taking these values into consideration, the desirable mounting intervals for the reinforcing supports for securing a buckling strength to withstand the load at the time of brazing by the reinforcing supports provided in the distributor will be obtained as follows: The minimum value is the max./min. proportion of the above fin pitch, that is, 4.2/1.4 (which means three times), and the maximum value is the ratio of the above set fin pitch (i.e., 21.4) to the minimum value (1.4) of the above corrugate fin pitch (that is, 21.4/1.4=15 times).

Thus, the desirable minimum pitch interval for the reinforcing supports=4.2/1.4=3 times, and the desirable maximum pitch interval for the reinforcing supports=21.4/1.4=15 times. That is, when the mounting interval for the reinforcing supports in the distributor section is 3 to 15 times the fin pitch in the heat exchange section, it is possible to secure a sufficient buckling strength without disturbing the flow of the fluid.

In accordance with the present invention, the structure of the main heat exchanger is designed as described above and, further, the structure of the distributors constituting the heat exchanger is improved to thereby reduce the pressure loss of the low pressure line, whereby the power of the air compressor is reduced. This feature proves also effective in the conventional air separating apparatus as shown in FIG. 1. However, by adding the following feature to the air separating apparatus, it is possible to further enhance the pressure loss reduction effect or attain other advantages.

Figure 13:
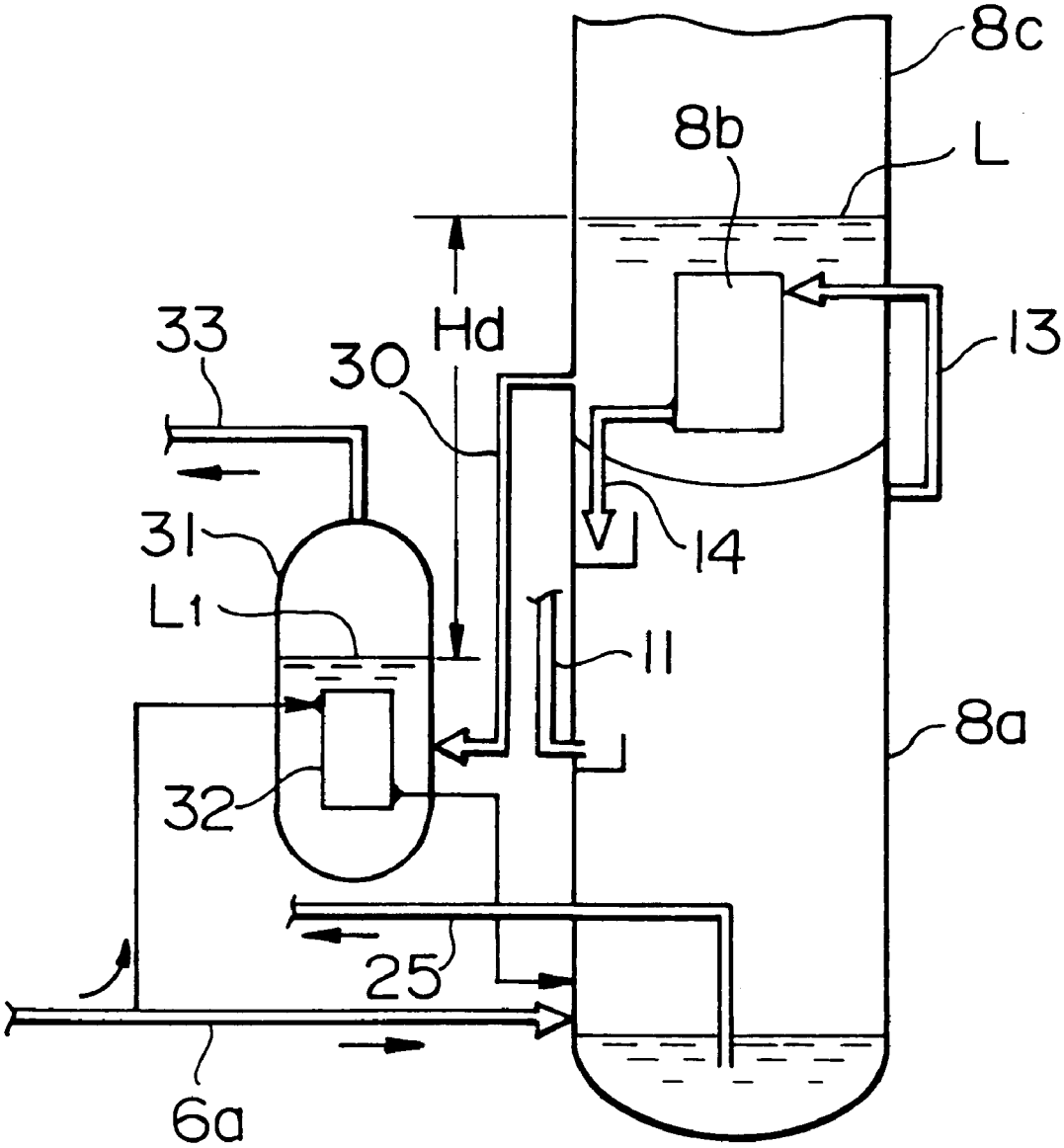
FIG. 13 is an essential-part flow diagram schematically illustrating the features of a method of and an apparatus for air separation preferably adopted in the present invention.

For example, FIG. 13 is a partial schematic representation of an air separating apparatus in which the above main heat exchanger is to be provided. The diagram only shows the upper and lower columns of a rectifying tower and the periphery thereof. As to the other portions, they may be deemed to be the same as those of the example shown in FIG. 1.

In the example shown in FIG. 1, the nitrogen gas roughly separated in the top section of the lower column 8*a* is utilized to heat the liquid oxygen at the bottom of the upper column 8*c* of the rectifying tower, and the oxygen-rich gas extracted from that section of the side wall which is above the level of the liquid oxygen is extracted from the line 17 as the oxygen gas product.

As shown in FIG. 13, in this embodiment, in contrast, the liquid air at the bottom of the upper column 8*c* of the rectifying tower is extracted from a line 30 in the form of liquid and led to an evaporation tower 31. A heat exchanger 32 for heating is provided in the evaporator 31. Part of the compressed air cooled by the main heat exchanger 7 and supplied to the lower column 8*a* of the rectifying tower is branched off and supplied to this heat exchanger 32. The liquid oxygen extracted from the upper column 8*c* of the rectifying tower is evaporated by heating by the evaporator 31 and, as in the above-described case, the coldness is recovered from a line 33 by the main heat exchanger 7. At the same time, the compressed air to which evaporation energy has been imparted from the heat exchanger 32 to cool it is supplied to the lower section of the lower column 8*a* of the rectifying tower.

By adopting this method, the following advantages (1) through (3) can be obtained:

(1) It is possible to increase the pressure of the oxygen gas product.

That is, when, as shown in the drawing, the evaporator 31 is provided below the level L of the liquid oxygen in the upper column 8*c* of the rectifying tower, the level $L_1$ of the liquid oxygen in the evaporator 31 is below the above level L, and the pressure of the liquid oxygen supplied to the evaporator 31 is higher by the liquid level difference (head difference) Hd between the level L of the liquid oxygen in the upper column 8*c* and the level $L_1$ of the liquid oxygen in the evaporator 31. The boiling point is raised in correspondence with this pressure rise. Since compressed air which is at a higher temperature than the crude nitrogen gas supplied to the main condenser 8*b* of the upper column 8*c* of the rectifying tower is branched off and supplied to the heat exchanger 32 for heating in the evaporator 31, the liquid air in the evaporator 31 receives heat enough for evaporation in spite of the increase in pressure and is evaporated. The pressure of the oxygen gas, which is extracted, is at a pressure higher by the above-mentioned difference in level (head difference) Hd. Generally speaking, the oxygen gas product is pressurized by a compressor before it is obtained. Since it is pressurized through the compressor in the last stage of the extraction line, increasing the pressure of the oxygen gas in this section leads to a reduction in the pressure rising energy of the compressor, thereby contributing to a reduction in the power of the equipment as a whole.

(2) It is possible to improve the purity of the oxygen gas product.

That is, as shown in FIG. 1, when extracting the oxygen gas from a position somewhat higher than the level of the liquid oxygen in the upper column 8*c* of the rectifying tower, it is impossible to make the purity of the oxygen gas higher than the purity of the liquid oxygen gas due to gas-liquid equilibrium. For example, when the oxygen concentration of the liquid oxygen is 90%, the purity of the oxygen gas extracted cannot but be 87 to 88% or so. However, when the method in which, as in this embodiment, the liquid oxygen at the bottom of the upper column 8*c* is taken out in the evaporator 31 in the form of liquid before it is evaporated by heating, and the pressure and temperature in the evaporator 31 are appropriately controlled, it is possible to extract an oxygen gas product which maintains the purity of the liquid oxygen at the bottom of the upper column 8*c*. That is, when the gas-liquid equilibrium (in which, for example, the concentration of the gas oxygen is 90% and the concentration of the liquid oxygen is 92%) in which the concentration of the gas oxygen is the same as the concentration of the liquid oxygen on the input side (that is, the oxygen transferred from within the upper column 8*c*), is secured by appropriately controlling the temperature/pressure conditions of the evaporator 31 and first discharging the volatilizing gas with high nitrogen content, and when, while maintaining this condition, the introduction of the liquid oxygen and the extraction of the gas oxygen are continuously conducted, it is possible to continuously obtain an oxygen gas of a concentration of 90% as the gas product.

(3) It is possible to reduce the pressure at which the compressed air is introduced in the lower column 8*a* of the rectifying tower, that is, it is possible to reduce the power of the material air compressor.

That is, as described in the above (2), the fact that the purity of the oxygen gas product is improved by the operation with the evaporator 31 means that the purity of the liquid oxygen collected at the bottom of the upper column 8*c* of the rectifying tower can be relatively lowered. When the purity of the liquid oxygen is lowered, its boiling point is lowered, so that it can be evaporated at a lower temperature. Thus, also regarding the oxygen gas serving as the heating source for evaporating the liquid oxygen in the upper column 8*c* (the gas transferred from the top section of the lower column 8*a* to the main condenser 8*b*), it is possible to perform operation at a lower pressure (When the pressure is lowered, the temperature at which the nitrogen condenses is lowered). As a result, an operation is possible in which the pressure of the lower column 8*a* is set at a relatively low level, which contributes to a reduction in the power of the material air compressor.

As described above, in accordance with the present invention, the main heat exchanger provided in the air separating apparatus is improved, and an open end type structure is adopted for the heat exchange unit in the section where the return gases, in particular, the exhaust nitrogen gas and/or the nitrogen gas, which has a high flow rate and extracted from the top section of the upper column or from the vicinity thereof, flow, whereby a reduction in the pressure loss in the low pressure line is achieved, with the result that it is possible to achieve a reduction in the power of the air compressor. There are no particular limitations regarding the other structural features, for example, the specific structure and mounting structure of the heat exchange unit constituting the main heat exchanger, and other equipment, for example, the construction of the air compressor, the cooler, the adsorber, the upper and lower columns of the rectifying tower, etc. and the piping, the connecting structure, etc. thereof; it is possible to appropriately select equipment and piping/connecting methods applicable to this type of air separating apparatus. For example, regarding the adsorber, it is possible to adopt, apart from the molecular sieve adsorber, some other type of adsorber as long as it is capable of removing the impurities contained in the air (water, carbon dioxide, hydrocarbon gas, etc.). Regarding the rectifying tower, the present invention is naturally applicable not only to the conventional plate-type rectifying tower, but also to a rectifying tower in which a reduction in pressure loss is achieved by using a structure filler material, such as Raschig ring, pall ring, Berl saddle, or inter-cross saddle.

In accordance with the present invention, constructed as described above, the section of the main heat exchanger through which the exhaust nitrogen gas or the nitrogen gas product passes is formed by an open end type heat exchange unit, whereby it is possible to restrain the pressure loss of the return gases in the main heat exchanger as much as possible, with the result that a reduction in the power of the material air compressor is achieved. Further, the operational efficiency of the air separating apparatus as a whole can be enhanced.

Further, by adding an evaporator wherein the air supplied to the lower column of the rectifying tower is used as a heat source of the evaporator, it is possible to attain the following advantages in addition to those described above: (1) It is possible to reduce the energy consumption of the compressor when the pressure of the oxygen gas product is increased to obtain it as the final product; (2) The purity of the oxygen gas product is increased; and (3) The pressure at which the compressed air is introduced in the lower column 8*a* of the rectifying tower is reduced, that is, the power of the material air compressor is further reduced.

Further, by using a main heat exchanger equipped with a distributor in which a plurality of supports are mounted at appropriate intervals so as to leave passage space for the fluid therebetween, it is possible to further reduce the pressure loss generated in the main heat exchanger and to further restrain the running power cost of the air separation equipment.

What is claimed is:

1. An air separation method, comprising:

cooling compressed air cooled with a main heat exchanger;

supplying the cooled compressed air to a lower column of a rectifying tower equipped with upper and lower columns;

passing exhaust nitrogen or nitrogen product gas from the upper column of the rectifying tower through an open end passage of the main heat exchanger so as to cool the compressed air, wherein the exhaust nitrogen or nitrogen product gas is entirely or partly caused to flow through said open end passage, whereby a reduction in the pressure loss of the return gas is achieved, and wherein the exhaust nitrogen or nitrogen product gas is only passed through open end passages in any heat exchangers used in said method.

2. An air separation method according to claim 1, wherein said exhaust nitrogen or nitrogen product gas is extracted from the top section of the rectifying tower or from the vicinity thereof.

3. An air separation method according to one of claim 1, wherein liquid oxygen at the bottom of the upper column of the rectifying tower is extracted and led to an evaporator and wherein part of the material air supplied to the lower column of the rectifying tower is utilized as heating source for said evaporator.

4. An air separation method according to one of claim 1, wherein, in said main heat exchanger, heat exchange is effected between the material air, exhaust nitrogen gas, nitrogen gas product and oxygen gas product.

5. An air separating apparatus, comprising:

a rectifying tower equipped with upper and lower columns; and a main heat exchanger configured to supply compressed air to the lower column of the rectifying tower, said main heat exchanger configured to receive exhaust nitrogen or nitrogen product gas from the upper column of the rectifying tower to cool the compressed air through said main heat exchanger, said main heat exchanger equipped with an open end passage through which the whole or part of the return gas flows, wherein said whole or part of the return gas flows only through open end passages of any heat exchanger included in said apparatus.

6. An air separating apparatus according to claim 5, wherein said return gas is extracted from the top section of the rectifying tower or from the vicinity thereof.

7. An air separating apparatus according to one of claim 5, wherein said air separating apparatus is equipped with an evaporator for receiving liquid oxygen at the bottom of the upper column and, further, equipped with a branching line for branching off the compressed air supply line to the lower column of the rectifying tower to utilize the compressed air as heating source for said evaporator.

8. An air separating apparatus according to one of claim 5, wherein said main heat exchanger is of a corrugate fin type, and wherein, at the fluid outlet or inlet of said main heat exchanger, there is arranged a distributor in which a plurality of supports are mounted at appropriate intervals so as to leave passage space for the fluid therebetween.

9. An air separating apparatus according to one of claim 5, wherein, in said main heat exchanger, two sets of distributors are provided on both the inlet and outlet sides of the heat exchange fluid to thereby enable four liquids to flow separately.

* * * * *